US008334480B2

(12) United States Patent
Yeung

(10) Patent No.: US 8,334,480 B2
(45) Date of Patent: Dec. 18, 2012

(54) ELECTRICALLY HEATED TOWEL RACK

(75) Inventor: Wing Yiu Yeung, Hong Kong (HK)

(73) Assignee: Advanced Materials Enterprises Company Limited, Hong Kong (HK)

( * ) Notice: Subject to any disclaimer, the term of this patent is extended or adjusted under 35 U.S.C. 154(b) by 376 days.

(21) Appl. No.: 12/680,199

(22) PCT Filed: Oct. 24, 2008

(86) PCT No.: PCT/CN2008/072810

§ 371 (c)(1),
(2), (4) Date: Mar. 26, 2010

(87) PCT Pub. No.: WO2009/056058

PCT Pub. Date: May 7, 2009

(65) Prior Publication Data

US 2010/0193493 A1 Aug. 5, 2010

(30) Foreign Application Priority Data

Oct. 26, 2007 (CN) ..... 2007 2 0172681 U

(51) Int. Cl.
*H04B 1/00* (2006.01)

(52) U.S. Cl. ..... 219/201; 219/521; 219/526; 219/536; 219/548; 219/202; 219/270; 219/383; 219/442

(58) Field of Classification Search ..... 219/201, 219/202–270, 383–442, 521, 526, 536, 548
See application file for complete search history.

(56) References Cited

U.S. PATENT DOCUMENTS 1,677,280 A * 7/1928 Gilbert ..... 219/473
3,217,137 A * 11/1965 Weitzner ..... 219/201
RE32,616 E * 3/1988 Graham ..... 219/385
4,849,610 A * 7/1989 Alvarez ..... 219/521
4,927,995 A * 5/1990 Lovett et al. ..... 219/385
6,137,092 A * 10/2000 Colombo et al. ..... 219/538
6,153,862 A * 11/2000 Job ..... 219/521
6,305,034 B1 * 10/2001 Perez Urrutia ..... 4/300.3
6,604,942 B2 * 8/2003 Sharp ..... 432/266
6,737,615 B2 * 5/2004 Lange et al. ..... 219/536
6,926,077 B2 * 8/2005 Kuga et al. ..... 165/170
6,946,624 B1 * 9/2005 Tomassetti ..... 219/386
6,948,629 B1 * 9/2005 McClay ..... 211/196
6,951,592 B2 * 10/2005 McConnell et al. ..... 156/211
7,374,139 B2 * 5/2008 Tsai et al. ..... 248/161
7,384,093 B2 * 6/2008 Rasmussen ..... 296/156
D597,773 S * 8/2009 Yeung ..... D6/546
8,143,553 B2 * 3/2012 Defranco et al. ..... 219/201
2006/0070307 A1 * 4/2006 Lambright ..... 52/79.5
2007/0001070 A1 * 1/2007 Ericson ..... 248/176.3

(Continued)

*Primary Examiner* — Fernando L Toledo
*Assistant Examiner* — Mohammed Shamsuzzaman

(57) ABSTRACT

An electrically heated towel rack including two parallel retractable arms (1,1') and an electric heating board (2) is provided. Each of the retractable arms has a fixed portion (12) and a retractable portion (14). A connecting member (11) is disposed at one end of the fixed portion (12) for connecting the fixed portion (12) and a wall (3). The electric heating board (2) is rotatably disposed between the two retractable arms (1,1') and supported by two support members (13), the support members (13) being respectively disposed on inner sides of the retractable portions (14) of the two retractable arms (1,1'). The electric heating board (2) can be an electric glass board. The distance between the electric heating board (2) and the wall (3) can be adjusted by pushing or pulling the retractable portions (14). Alternatively, the electric heating board (2) can be rotated to a vertical position.

10 Claims, 3 Drawing Sheets

U.S. PATENT DOCUMENTS

2008/0041840 A1* 2/2008 Bader ..... 219/521
2008/0053939 A1* 3/2008 Lam ..... 211/123
2008/0210678 A1* 9/2008 Crane ..... 219/201
2008/0289094 A1* 11/2008 Blom ..... 4/559
2009/0230119 A1* 9/2009 Dupont ..... 219/521
2010/0171021 A1* 7/2010 Smith ..... 248/558
2010/0206862 A1* 8/2010 Defranco et al. ..... 219/201
2012/0025555 A1* 2/2012 Rasmussen ..... 296/24.33
2012/0078469 A1* 3/2012 Karner et al. ..... 701/36
2012/0181240 A1* 7/2012 Crowley ..... 211/26

* cited by examiner

ELECTRICALLY HEATED TOWEL RACK

BACKGROUND OF THE INVENTION

1. Field of Invention

The present invention relates to an apparatus for daily use, and more particularly, to an electrically heated towel rack capable of generating heat when powered by electricity for heating towels or preserving the temperature thereof.

2. Description of Related Art

In daily life, wet towels, after being used, may lead to growth of bacteria, which is bad to human health. In winter, especially in the north, cold weather often makes clothes and towels cold and therefore uncomfortable to use. For such reasons, electrically heated towel racks have been designed. These electrically heated towel racks have an electric heating unit installed therein. The electric heating unit, when being powered by electricity, increases the temperature of a heat conduction tube thereof so as to heat towels.

Currently, most electrically heated towel racks in the market have a heating circuit that includes a heating wire. The heating wire suffers from disadvantages of low heating efficiency and low heat endurance so that frequent maintenance needs to be made to the heating wire in the electrically heated towel rack.

SUMMARY

It is an object of the present invention to provide an electrically heated towel rack having an electric heating unit that has a long lifetime, good endurability, a large heating area and multiple working states. In one of the working states wet towels after being used can be hanged on the electrically towel rack to be quickly heated, and in another working state towels and clothes can be disposed thereon.

To achieve the above object, a preferred embodiment of the present invention provides an electrically heated towel rack that includes two parallel retractable arms and an electric heating board. Each of the retractable arms has a fixed portion and a retractable portion. A connecting member is disposed at an end of the fixed portion for connecting the fixed portion and a wall. Two axial holes or short axles are symmetrically and respectively disposed on inner sides of the retractable portions of the two retractable arms. Two short axles or axial holes are correspondingly disposed on two ends and close to a side of the electric heating board respectively. The short axles/axial holes on the two ends of the electric heating board are engaged with the axial holes/short axles on the inner sides of the retractable portions of the two retractable arms so that the electric heating board is rotatably supported between the two retractable arms. Two support members are respectively disposed on the inner sides of the retractable portions of the two retractable arms. The distance between each of the support members and the axial hole/short axle on the inner side of the retractable arm where the support member resides is less than the width of the electric heating board.

The electrically heated towel rack uses the electric heating board to load towels and clothes. When powered by electricity, the electric heating board can generate heat to heat the towels and the clothes disposed thereon. The electrically heated towel rack has a simple structure and an elegant look. In addition, the electric heating board has a long lifetime, good endurability, a large heating area.

The electric heating board can be rotated to a horizontal position so that towels and clothes can be disposed thereon. The distance between the electric heating board and the wall can be adjusted by pushing or pulling the retractable portion so that larger towels can be disposed on the heated towel rack as well. Alternatively, the electric heating board can be rotated to a vertical position so that towels can be disposed thereon unfolded and thereby heated quickly.

Other advantages and novel features will be drawn from the following detailed description of preferred embodiment with the attached drawings.

DETAILED DESCRIPTION

Figure 6:
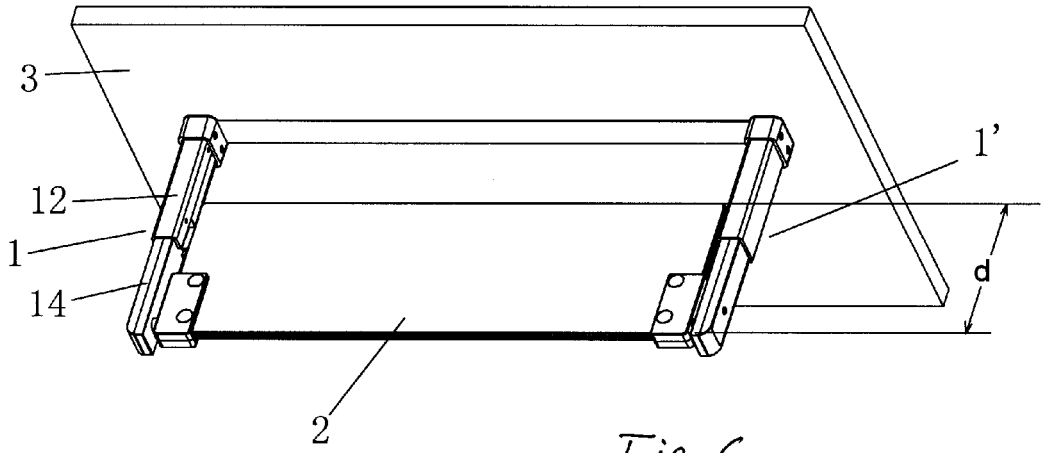
FIG. 6 illustrates still another working state of the electrically heated towel rack depicted in FIG. 1.

Referring to FIG. 1-FIG. 6, an electrically heated towel rack according to a preferred embodiment of the present invention is provided. The electrically heated towel rack includes two parallel retractable arms 1 and 1', and an electric heating board 2. The two parallel retractable arms 1 and 1' respectively includes a fixed portion 12 and a retractable portion 14. A connecting member 11 is disposed at an end of the fixed portion 12 for connecting the fixed portion 12 and a wall 3. Two axial holes (not shown in figures) are symmetrically and respectively disposed on inner sides of the retractable portions 14 of the two retractable arms 1 and 1'. Two short axles (not shown in figures) are correspondingly disposed on two ends and close to a side of the electric heating board 2 respectively. The short axles on the two ends of the electric heating board 2 are engaged with the axial holes on the inner sides of the retractable portions 14 of the two retractable arms 1 and 1' so that the electric heating board 2 is rotatably supported between the two retractable arms 1 and 1'. Two support members are respectively disposed on the inner sides of the retractable portions 14 of the two retractable arms 1 and 1'. The support members can be formed into a bar connecting the inner sides of the retractable portions 14 of the two retractable arms 1 and 1'. In this embodiment, the support members are two electric heating board holders 13. Referring to FIG. 6, the distance between each of the support members and the axial hole on the inner side of the retractable arm where the support member resides is less than the width of the electric heating board 2 so that when the electric heating board 2 is rotated to a horizontal position the support members can support the electric heating board 2 to stay in the horizontal position.

The retractable arm 1 (or 1') can have a structure in which the retractable portion 14 is covered inside the fixed portion 12. With this structure, because the retractable portion 14 is inside the fixed portion 12, a hole needs to be formed on the fixed portion 12 so that the retractable portion 14 with the support member can glide inside the fixed portion 12. More specifically, the fixed portion 12 of the retractable arm 1 has a tube structure with a slot hole on a side thereof. The retractable portion 14 of the retractable arm 1 is slidably inserted to the tube shaped fixed portion 12. The support member 13 on the retractable portion 14 sticks out from the slot hole on the side of the tube shaped fixed portion 12. The fixed portion 12 of the retractable arm 1 can be a cylindrical tube, an elliptical tube or a cubical tube with a slot hole on a side thereof. In this embodiment, the fixed portion 12 of the retractable arm 1 is a cubical tube with a slot hole on a side thereof.

The retractable arm 1 (or 1') can have a structure in which the fixed portion 12 is covered inside the retractable portion 14. For example, the retractable portion 14 has a tube structure and is slidably configured in the fixed portion 12 of the retractable arm 1 (or 1'). The axle hole for installing the electric heating board 2 is formed close to a front end of the tube shaped retractable portion 14. The support member 13 is disposed close to a back end of the tube shaped retractable portion 14. The retractable portion 14 of the retractable arm 1 can be a cylindrical tube, an elliptical tube or a cubical tube.

In another embodiment, the retractable arm 1 and 1' can be replaced by non-retractable pieces under which sliding extension of the towel rack is not required. The support members 13 can be replaced by a bar connecting the two non-retractable arms close to their back ends.

The electric heating board 2 can be a glass electric heating board including two glass plates of identical sizes sticking to each other. The plates can also be made of other suitable materials. A conductive film is deposited on an inner side of at least one of the glass plates. Two electrode stripes are disposed between the glass plates close to the left and right, or the upper and lower edges of the glass plates. Both of the electrode stripes are electrically connected with the conductive film and to an AC power supply through a wire. The wire can be disposed inside the retractable arms 1 and 1' to make a more compact appearance. The power supply used in this embodiment can be a DC power supply as well. At 12V D.C. voltage, a temperature of 50° C. can be reached and maintained, and at 18V D.C. voltage, a temperature of 70° C. can be reached and maintained.

Clipper 21, which includes short axles on two ends thereof, can be installed to the two ends of the electric heating board 2 so as to install the short axles to the electric heating board 2. The clippers 21 are fixed on the electric heating board 2 through bolts and nuts.

In this embodiment, by installing short axles on the electric heating board 2 and forming the corresponding axial holes on the retractable arms 1 and 1', the electric heating board 2 can be rotatably supported between the two retractable arms 1 and 1'. It is to be understood that alternatively the axial holes can be formed on the electric heating board 2 and the corresponding short axles can be installed on the retractable arms 1 and 1' so that the electric heating board 2 can be rotatably supported between the two retractable arms 1 and 1' as well.

Figure 1:
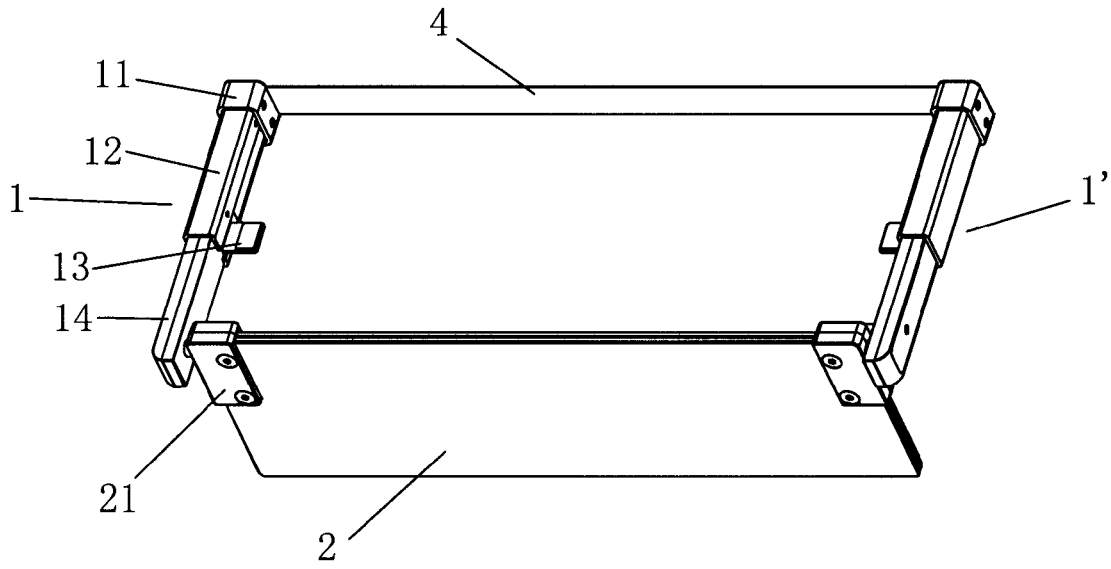
FIG. 1 is a perspective view of an electrically heated towel rack in accordance with a preferred embodiment of the present invention.
Figure 2:
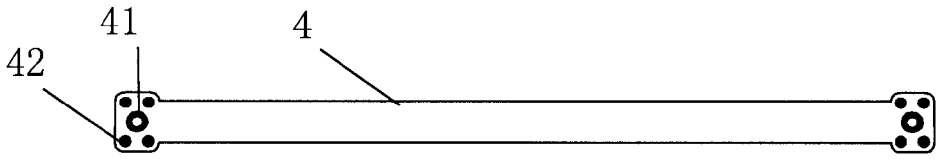
FIG. 2 is an installation component for installing the electrically heated towel rack depicted in FIG. 1.
Figure 3:
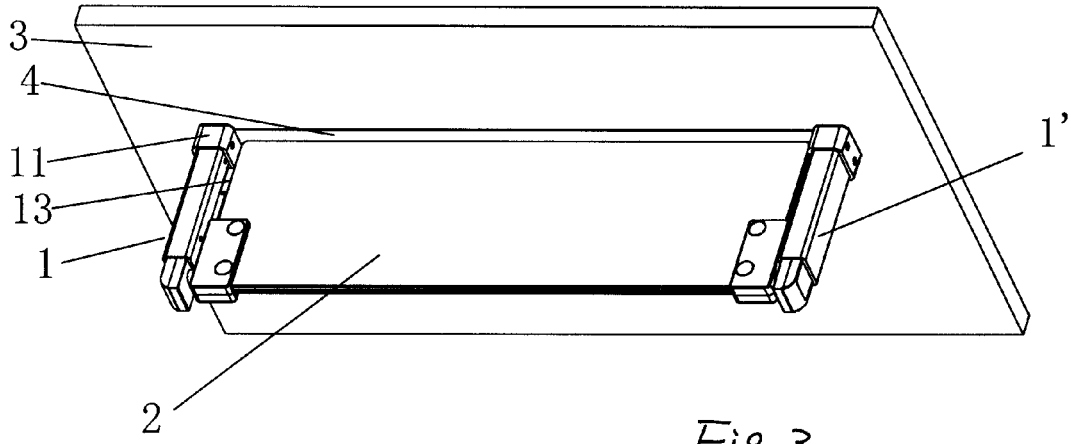
FIG. 3 illustrates a working state of the electrically heated towel rack depicted in FIG. 1.

FIG. 2 illustrates an installation component for installing the electrically heated towel rack. Referring to FIG. 2 and FIG. 3, in installation, first an installation member 4 is installed to the wall 3 by respectively plugging two plug bolts through two installation holes 42 at two ends of the installation member 4 onto the wall 3. Next, the connecting members 11 of the retractable arms 1 and 1' are fixed to the wall 3 through positioning holes 41 on the two ends of the installation member 4. Then the fixed portions 12 of the retractable arms 1 and 1' are respectively fixed in the connecting members 11. Finally the electric heating board 2 is installed between the retractable portions 14 of the retractable arms 1 and 1'. It is to be understood that alternatively the installation of the installation member 4 can be eliminated and the connecting members 11 of the retractable arms 1 and 1' can be directly installed onto the wall 3, with some form of mounting blocks.

Figure 4:
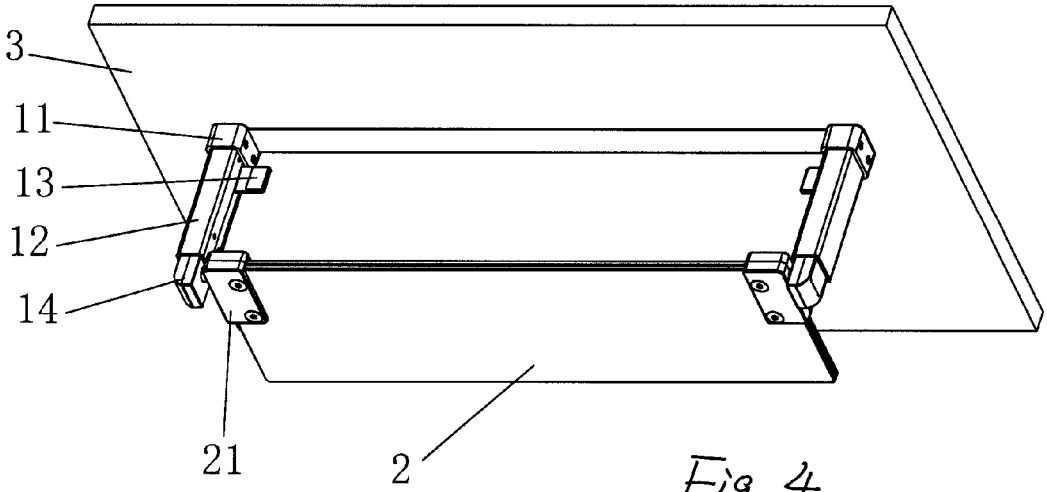
FIG. 4 illustrates another working state of the electrically heated towel rack depicted in FIG. 1.
Figure 5:
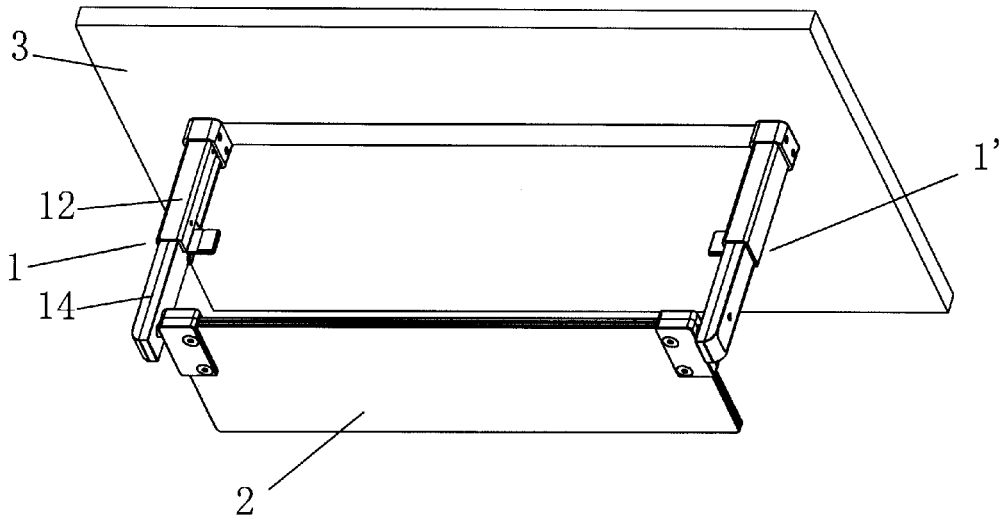
FIG. 5 illustrates yet another working state of the electrically heated towel rack depicted in FIG. 1.

Referring to FIG. 3-FIG. 6, a user can push the retractable portion 14 of the retractable arms 1 and 1' into the fixed portion 12 and rotate the electric heating board 2 to a horizontal position. In this working state, the electric heating board 2 stays in the horizontal position under the support of the support members 13 (as shown in FIG. 3). The user may place towels and clothes on the electric heating board 2. When powered by electricity, the electric heating board 2 can keep the towels and clothes thereon dry and prevent mold and bacteria from growing there. As shown in FIG. 4, the electric heating board 2 can be rotated to a vertical position and the user can place the used and wet towels on the electric heating board 2 unfolded with a maximum area of the wet towels being in contact with the electric heating board 2 so that the wet towels can be heated and dried quickly. As showing in FIG. 5, according to the specific need of the user, the retractable portion 14 of the retractable arms 1 and 1' can be pulled out from the fixed portion 12 so as to increase the distance between the electric heating board 2 and the wall 3. As shown in FIG. 6, when the user needs to place relatively large towels on the electric heating board 2, the retractable portion 14 of the retractable arms 1 and 1' can be pulled out from the fixed portion 12 so as to increase the distance between the electric heating board 2 and the wall 3, and the electric heating board 2 can be rotated to a horizontal position.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electrically heated towel rack comprising two parallel retractable arms and an electric heating board, each of the retractable arms having a fixed portion and a retractable portion, a connecting member being disposed at an end of the fixed portion for connecting the fixed portion and a wall, two axial holes or short axles being symmetrically and respectively disposed on inner sides of the retractable portions of the two retractable arms, two short axles or axial holes being correspondingly disposed on two ends and close to a side of the electric heating board respectively, the short axles or axial holes on the two ends of the electric heating board being engaged with the axial holes or short axles on the inner sides of the retractable portions of the two retractable arms so that the electric heating board is rotatably supported between the two retractable arms, two support member being respectively disposed on the inner sides of the retractable portions of the two retractable arms, the distance between each of the support members and the axial hole or short axle on the inner side of the retractable arm where the support member resides being less than the width of the electric heating board.

2. The electrically heated towel rack of claim 1, wherein the fixed portion of the retractable arm has a tube structure with a slot hole on a side thereof, the retractable portion of the retractable arm is slidably inserted to the tube shaped fixed portion, and the support member on the retractable portion sticks out from the slot hole on the side of the tube shaped fixed portion.

3. The electrically heated towel rack of claim 2, wherein the fixed portion of the retractable arm can be a cylindrical tube, an elliptical tube or a cubical tube with a slot hole on a side thereof.

4. The electrically heated towel rack of claim 1, wherein the retractable portion has a tube structure and is slidably configured in the fixed portion of the retractable arm, the axle hole for installing the electric heating board is formed close to a front end of the tube shaped retractable portion, and the support member is disposed close to a back end of the tube shaped retractable portion.

5. The electrically heated towel rack of claim 4, wherein the retractable portion of the retractable arm can be a cylindrical tube, elliptical tube or a cubical tube.

6. The electrically heated towel rack of claim 1, wherein the electric heating board comprises two glass plates or other suitable materials of identical sizes sticking to each other, a conductive film is deposited on an inner side of at least one of the glass plates, two electrode stripes are disposed between the glass plates close to the left and right, or the upper and lower edges of the glass plates, and both of the electrode stripes are electrically connected with the conductive film and to a power supply through a wire.

7. The electrically heated towel rack of claim 6, wherein the power supply of the electric heating board is an AC power supply.

8. The electrically heated towel rack of claim 6, wherein the power supply of the electric heating board is a DC power supply.

9. The electrically heated towel rack of claim 1, wherein the support members are two holders.

10. The electrically heated towel rack of claim 1, wherein the support members are formed into a bar connecting the inner sides of the retractable portions of the two retractable arms.

* * * * *